United States Patent [19]

Brickner

[11] Patent Number: 4,824,077

[45] Date of Patent: Apr. 25, 1989

[54] CONCRETE FENCE POST

[76] Inventor: Melvin J. Brickner, #208-33298 Robertson Ave., Abbotsford, B.C., Canada, V2S 1Z5

[21] Appl. No.: 68,606

[22] Filed: Jun. 30, 1987

Related U.S. Application Data

[63] Continuation-in-part of Ser. No. 880,617, Jun. 30, 1986.

[51] Int. Cl.[4] ..... B21F 27/00

[52] U.S. Cl. ..... 256/51; 256/48; 256/50

[58] Field of Search ..... 256/48, 50, 51, 49

[56] References Cited

U.S. PATENT DOCUMENTS

| | | | |
|---|---|---|---|
| 347,956 | 8/1886 | Pancoast | 256/49 X |
| 1,107,406 | 8/1914 | Burns | 256/51 |
| 4,621,783 | 11/1986 | Wier | 256/49 X |

FOREIGN PATENT DOCUMENTS

| | | | |
|---|---|---|---|
| 301951 | 12/1928 | United Kingdom | 256/50 |

*Primary Examiner*—Andrew V. Kundrat
*Attorney, Agent, or Firm*—James G. Staples

[57] ABSTRACT

This invention relates generally to a concrete fence post having plastic insert members cast therein at desired locations. The plastic insert members accommodate traditional fasteners such as fencing staples or nails and thereby provide a quick and easy means for attaching barbed wire and the like to the concrete post.

7 Claims, 2 Drawing Sheets

CONCRETE FENCE POST

This is a continuation-in-part of the copending application, Ser. No. 880,617, filed on June 30, 1986.

FIELD OF THE INVENTION

This invention relates generally to fence posts which support fencing material such as barbed wire. More specifically, the concrete fence post of this invention can be easily, economically, and reliably used to support any one of a number of such fencing materials by means of conventional fasteners, such as common fencing staples or nails.

BACKGROUND OF THE INVENTION

Fence posts have been known for a long time and have traditionally been made of wood. Wood has been the material of choice due to its availability and ability to accommodate traditional fasteners, such as nails or staples. Such fasteners are preferred by persons constructing fences because they are inexpensive, readily available, and easy to use.

However, wood is no longer as plentiful as it once was, and it may not be available in some regions. Also, wood does not have the strength or rigidity of many other building materials, such as concrete.

Indeed, concrete is more weather resistant, rigid and durable; moreover, in damp climates, wood has a tendency to rot, and in dry climates, wood may be a fire hazard. Concrete on the other hand does not rot and is not flammable. Concrete's fire resistance is of particular significance in areas where unwanted vegetation is usually "burnt off" for aesthetic or safety reasons, such as along railroad right of ways.

Typically however, concrete fence posts are not adaptable to conventional fasteners, and many concrete post designs require complicated or expensive fastening systems. Concrete posts may also require one or more reinforcement rods to add needed strength and integrity, and such rods may corrode if subjected to ambient conditions.

Finally, concrete posts can be difficult to anchor into the ground. Concrete typically absorbs and dissipates heat more quickly than the surrounding soil into which the post is placed, and tiny voids can occur between the post and ground. Thereafter, moisture can seep into the voids, enlarging the voids during freezing and providing space for more moisture during thawing. Also, external forces on the heavy concrete posts may also cause them to shift and wobble.

Consequently, it is an object of this invention to provide a concrete fence post which can be easily and reliably anchored into the ground.

A further object of this invention is to provide a means for attaching fencing wire and similar-type fencing materials to concrete fence posts by means of conventional fasteners.

A further object of this invention is to provide a non-corrosive concrete fence post with sufficient structural integrity such that the post can be anchored into the ground using a conventional hammer means.

Other objects and features of the invention will become apparent to those skilled in the art from the following specification when read in the light of the annexed drawings.

SUMMARY OF THE INVENTION

This invention relates generally to a concrete fence post having plastic insert members cast therein at desired locations. The plastic insert members accommodate traditional fasteners such as fencing staples or nails and thereby provide a quick and easy means for attaching barbed wire and the like to the concrete post.

DESCRIPTION OF THE DRAWINGS

The preferred embodiment of the invention is illustrated more or less diagrammatically in the accompanying drawings wherein.

DETAILED DESCRIPTION OF THE PREFERRED EMBODIMENT

Like reference numbers will be used to refer to like parts from Figure to Figure in the following description of the preferred embodiment of the invention.

Figure 1:
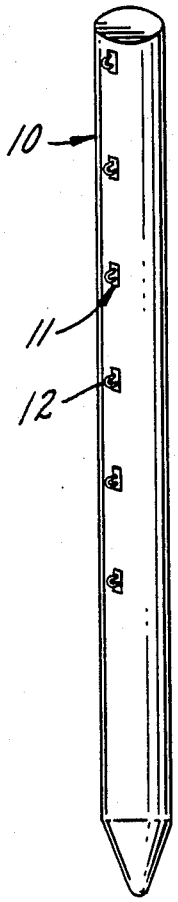
FIG. 1 is a perspective front side view of the preferred embodiment of the invention.

The concrete fence post of this invention is shown generally at 10 in FIG. 1. As shown by this Figure, the post has plastic polypropylene inserts indicated generally at 11, which forms a seat for wire staples 12. Conventional fencing securement means, such as wire staples 12, are driven into the inserts and project radially outward beyond the post's outer surface as shown in FIG. 1. These inserts and their associated staples are vertically aligned and spaced to accommodate the desired fencing material to be attached to the post. A means is thereby provided for securing conventional fencing material to the post using conventional fastener means.

Figure 2:
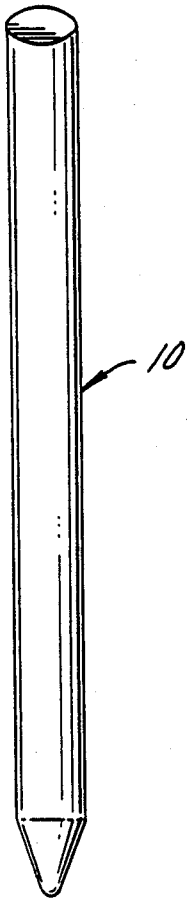
FIG. 2 is a perspective rear side view.

FIG. 2 discloses a perspective rear view of the preferred embodiment. In this embodiment, the rear portion does not have plastic insert seats for receiving fencing staples, although such a design is possible if fencing material is to be fastened on both sides of the post.

Figure 3:
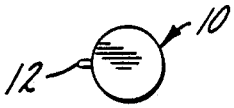
FIG. 3 is a top plan view.

FIG. 3 is a top view of the post and shows more specifically the outwardly projecting staples 12. It will be noted that the entire top surface of the post is concrete, and no steel or other material is exposed. This view also illustrates the post's flat top portion upon which force can be exerted when driving the post into the ground during installation, although a drive cap can be used if desired.

Figure 4:
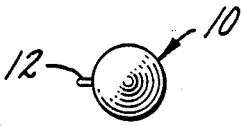
FIG. 4 is a bottom plan view

FIG. 4 discloses the post's tapered bottom portion. This tapered portion is important, because unlike many conventional posts having flat bottoms, the concrete post of this invention has a tapered concrete end which allows the post to be driven into the ground, thereby firmly compressing the ground around the post as it is installed. The tapered bottom portion prevents loosening of the post, because the compressed soil around the post is typically free of voids, and this prevents moisture accumulation. Furthermore, the compressed soil around the post's tapered portion provides a solid barrier perpendicular to the tapered surface, thereby providing a secure foundation which substantially precludes unwanted movement by the post.

Figure 5:
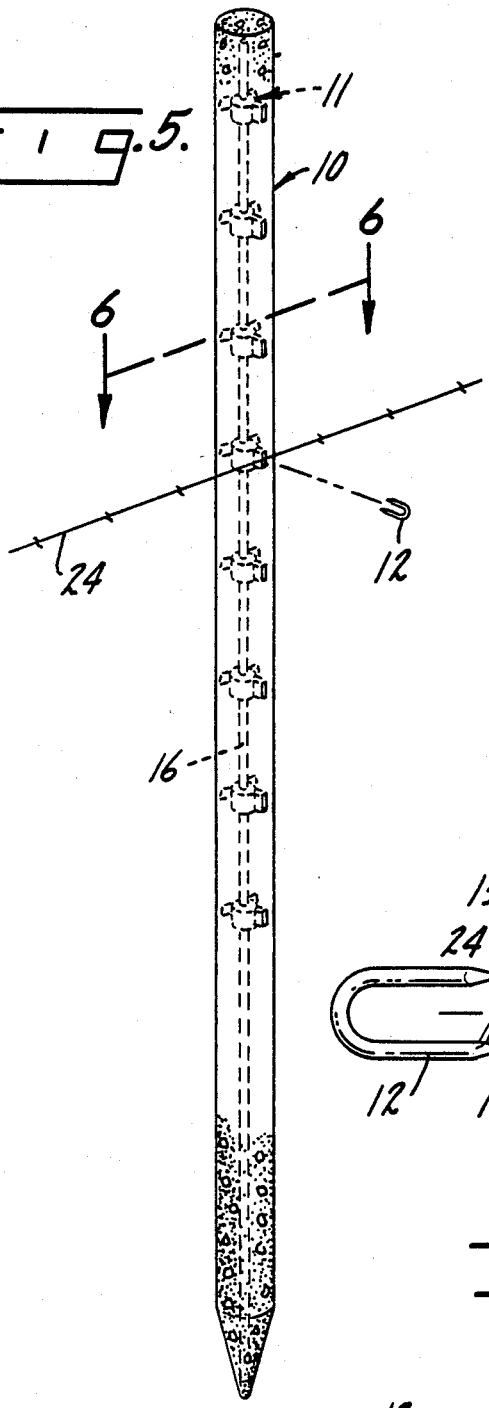
FIG. 5 is a perspective side view in greater detail of the preferred embodiment in combination with a conventional fencing wire and staple fastener.

FIGS. 5 through 9 add further clarity. As can be seen in FIG. 5, the concrete post has a central steel reinforcement bar 16. The reinforcement bar is completely encased in concrete, and since it is not exposed to ambient conditions, it will not corrode. When a force is exerted on the top of the post, such as by means of a hammer, the reinforcement bar will add structural integrity to the post and prevent any adverse affect on the post due to the downward force. The size of the reinforcement bar is calculated by conventional engineering design considerations, thereby providing a post with a desired strength.

Figure 7:
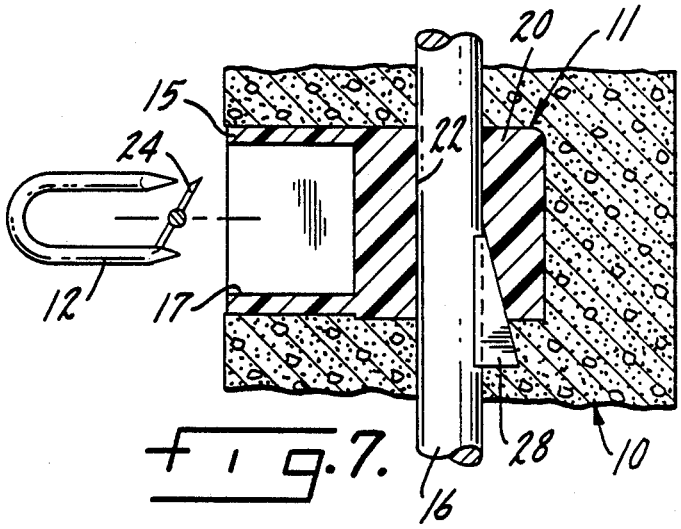
FIG. 7 is a view taken substantially along the line 7—7 in FIG. 6.
Figure 8:
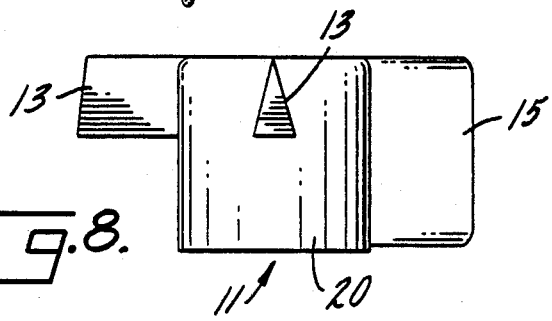
FIG. 8 is a perspective side view of the plastic insert within the concrete post.

The reinforcement bar 16 provides structural rigidity, and absorbs external forces on the post, particularly tensile stresses, and distributes forces substantially evenly within the post. The plastic inserts indicated at 11 in FIG. 1 are shown in greater detail in FIGS. 5 through 8. These inserts have a central aperture 22 through which the bar 16 extends. The inserts have wedged, shock dissipating extensions 13 and a pocket extension 15; all of which extend radially outward equidistant from one another. Extensions 13 are preferably triangular in cross section as best seen in FIG. 8. Pocket extension 15 extends vertically a distance sufficient to form a pocket 17 within which a staple or other securement means is secured. Preferably, the width of the pocket is slightly less than the thickness for the fastener so that a gripping action is created.

Figure 6:
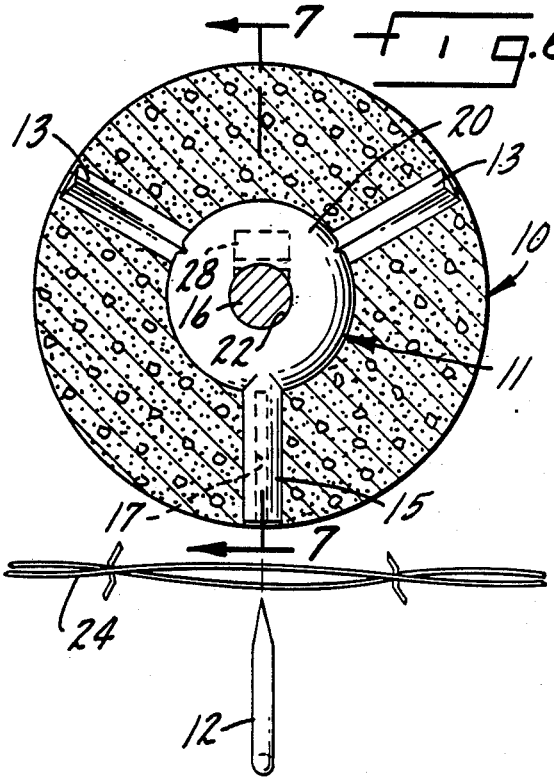
FIG. 6 is a view taken substantially along the line 6—6 in FIG. 5.

As can be seen in FIG. 6, to attach a conventional fencing wire 24 to the post, a conventional fencing staple 12 is inserted into the pocket of extension 15 and the pointed tips of the staple can then be embedded into the solid plastic main body 20. The polypropylene plastic main body 20 provides greater holding power than many wood materials.

In addition, the plastic insert main body 20 has sufficient elasticity to allow the staple 12 to be pried out and reinserted many times without adversely affecting the ability of the plastic body to grip the staple. Consequently, not only is the holding power typically greater for the concrete post relative to wooden posts, but the fasteners can be removed and replaced without loss of holding power as is sometimes the case with wooden posts.

Figure 9:
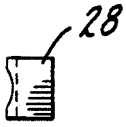
FIG. 9 is a top view of the plastic insert locking wedge.

FIG. 8 shows a side view of the plastic insert member 11, and FIG. 9 shows a plastic wedge locking member 28 used to secure the insert 11 to the reinforcement bar 16 prior to encasing the bar and plastic inserts in concrete. The wedge locking member 28 is wedged between the inner surface of the central aperture 22 of insert 11 and the outside surface of reinforcement bar 16 as shown in FIG. 7.

Consequently, the concrete post can be firmly anchored by driving the post into the ground using conventional means such as a hammer, and the concrete post can withstand the hammering force due to the added strength resulting from the internal reinforcing bar and the consequent dissipation of force throughout the post. The pointed bottom portion is thereby forced into the ground, and any subsequent external forces will not loosen the post, because the downward driving force of the post during installation compacts the soil around the tapered bottom of the post, thereby eliminating any voids around the post and thereby maintaining significant perpendicular support to the outer surface of the bottom portion of the post.

Once installed, the conventional fencing material such as barbed wire can be fastened to the post by placing the wire between the front tips of the staple, pushing the front tips of the staple into the hollow extension portion of the insert and embedding the staple into the solid plastic body of the insert using conventional means.

It should be understood that the foregoing disclosure relates to only the preferred embodiment of the invention and that numerous modifications or alterations may be made therein without departing from the spirit and scope of the invention as set forth in the appended claims.

I claim:

1. A concrete fence post capable of supporting multiple strands of fencing materials such as barbed wire by means of conventional fasteners, said post including, a main body portion composed of concrete, and a reinforcement is located substantially at the radial center of said main body portion, said reinforcement rod supporting at least one yielding insert member received on and carried by the rod, said insert member having an extension portion extending to and exposed at the surface of the post and a pocket in said extension having a width less than the thickness of a conventional fencing staple and which provides a seat for said staple whereby said staple can be repeatedly gripped and held by said insert member.

2. The concrete fence post of claim 1 wherein said post comprises a solid concrete top, and said reinforcement bar extends from just below the top of said post downwardly.

3. The concrete post of claim 2 wherein the bottom portion of said post is tapered.

4. The concrete post of claim 3 wherein said insert member includes at least one generally radially extending extension protruding therefrom.

5. The concrete post of claim 4, wherein said post further comprising a wedge locking means which secures said insert means to said reinforcement bar.

6. A concrete fence post capable of releasably engaging a conventional fencing staple and having structural integrity sufficient to allow said post to be driven and reliably anchored into the ground, said post comprising:

a concrete main body having a tapered bottom end portion;

said concrete main body encasing a reinforcement rod located along the radial center of said post;

said reinforcement rod carrying at least one plastic insert member, said plastic insert member comprising a central portion and at least one generally radial extension protruding generally perpendicularly to the axis of said reinforcement bar, said central portion defining an aperture through which said reinforcement rod extends;

said generally radial extension extending substantially to the surface of said concrete main body and defining a pocket whereby a conventional fastener can be inserted into said pocket and imbedded into the plastic central portion by conventional means, said central portion having sufficient density to reliably hold a conventional fastener embedded therein.

7. A concrete fence post having a tapered bottom end portion and substantially flat top end portion, said post being capable of supporting barbed wire by means of a conventional fencing fastener, said post including, a concrete main body portion having a tapered bottom end portion and a substantially flat top end portion, said concrete main body portion encasing a metal reinforcing rod, said reinforcing rod being at substantially the radial center of said main body portion and supporting at least one plastic insert member, said plastic insert member having a central body portion defining an aperture through which said reinforcing rod extends, said plastic insert member being secured to said rod by means of a wedge locking means forced between said plastic insert member and said rod, thereby locking said rod and insert member to one another, said plastic insert member also having three protrusions generally equidistant from one another extending perpendicularly to the plane of said reinforcing rod, at least one protrusion extending substantially to the outer surface of said concrete main body and defining a pocket whereby a conventional fencing fastener can be inserted into and gripped by the pocket and the said central body portion of said plastic insert member, said central body portion being sufficiently elastic to allow multiple fastener insertions and removals without significantly adversely affecting the holding power of said central body portion.

* * * * *